US007182060B2

(12) United States Patent
Lee

(10) Patent No.: US 7,182,060 B2
(45) Date of Patent: Feb. 27, 2007

(54) INTAKE-AIR SYSTEM OF V-TYPE ENGINE

(75) Inventor: Sihun Lee, Anyang-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/173,456

(22) Filed: Jun. 30, 2005

(65) Prior Publication Data

US 2006/0000439 A1 Jan. 5, 2006

(30) Foreign Application Priority Data

Jul. 2, 2004 (KR) ..... 10-2004-0051458

(51) Int. Cl.
*F02M 35/04* (2006.01)

(52) U.S. Cl. ..... 123/198 E; 123/184.21

(58) Field of Classification Search ..... 123/198 E, 123/184.21
See application file for complete search history.

(56) References Cited

U.S. PATENT DOCUMENTS

| | | | | |
|---|---|---|---|---|
| 4,300,511 | A * | 11/1981 | Lang | 123/520 |
| 6,598,580 | B2 * | 7/2003 | Baumann et al. | 123/198 E |
| 6,863,044 | B2 * | 3/2005 | Nakamura et al. | 123/198 E |
| 2004/0134460 | A1 * | 7/2004 | Kino et al. | 123/198 E |
| 2006/0006016 | A1 * | 1/2006 | Nishizawa | 180/219 |

* cited by examiner

*Primary Examiner*—Noah P. Kamen
*Assistant Examiner*—Jason Benton
(74) *Attorney, Agent, or Firm*—Morgan Lewis & Bockius LLP

(57) ABSTRACT

An intake box having an appropriate size to reduce intake noise is mounted at an upper portion of an engine by using the structural feature of a V-type engine, thereby minimizing the intake noise. The cross-sectional area of a relative intake passage is further expanded to decrease the intake resistance, resulting in an improvement of the engine output.

17 Claims, 4 Drawing Sheets

INTAKE-AIR SYSTEM OF V-TYPE ENGINE

CROSS-REFERENCE TO RELATED APPLICATIONS

The present application is based on, and claims priority from, Korean Application Ser. No. 10-2004-0051458, filed on Jul. 2, 2004, the disclosure of which is hereby incorporated by reference herein in its entirety.

FIELD OF THE INVENTION

The present invention relates to an intake-air system of a V-type engine. More particularly, the present invention relates to an intake-air system of an engine that is beneficial for maximizing the space of an engine room mounted with the V-type engine and reducing intake noise and intake resistance.

BACKGROUND OF THE INVENTION

Generally, an intake-air system of an engine requires a passage for which fresh air can enter into the engine and to optimize the engine by decreasing intake noise and resistance.

In order to suppress the intake noise of the intake-air system, either a narrow cross-sectional area for the intake passage or a large air cleaner box has been used. Alternatively, the cross-sectional area of the intake passage has been expanded to reduce the intake resistance of the intake-air system.

Thus, a voluminous air cleaner box has been required in order to suppress the intake noise, and the cross-sectional area of the intake passage must be appropriately formed to minimize the intake resistance, thereby optimizing the function of the engine intake-air system. However, since the engine room is limited in space, it is difficult to find enough space to mount a large air cleaner box.

SUMMARY OF THE INVENTION

Embodiments of the present invention are provided to obtain a space appropriate in size for installing an air cleaner box in an engine room by using the structural feature of a V-type engine, thereby improving the engine function.

An intake-air system of a V-type engine includes an intake box disposed on top of cylinder heads. A passage forming means allows both spaces of the intake box, installed along the lateral direction of the vehicle, to form an air passage. An air duct is connected to the front surface of one of both spaces of the intake box. A filter element is equipped at the one space of the intake box to filter the air entered into the air duct. A front connecting tube connects an intake manifold and the front surface of the other space of the intake box.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Figure 1:
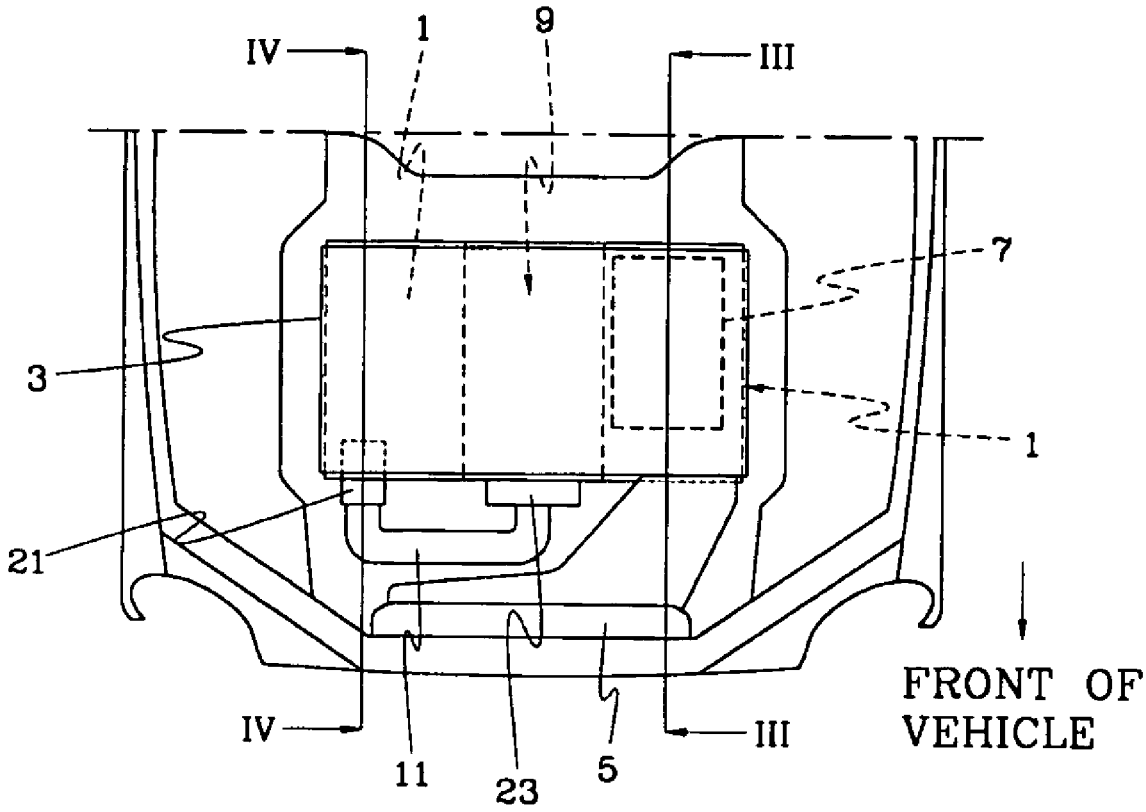
FIG. 1 illustrates an intake-air system of a V-type engine mounted in an engine room according to an embodiment of the present invention.
Figure 2:
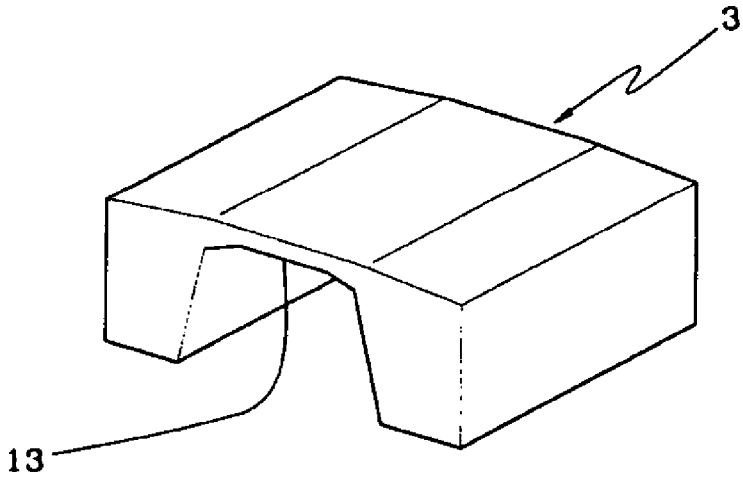
FIG. 2 is a perspective view of an intake box for depicting a passage forming means applied in FIG. 1.
Figure 3:
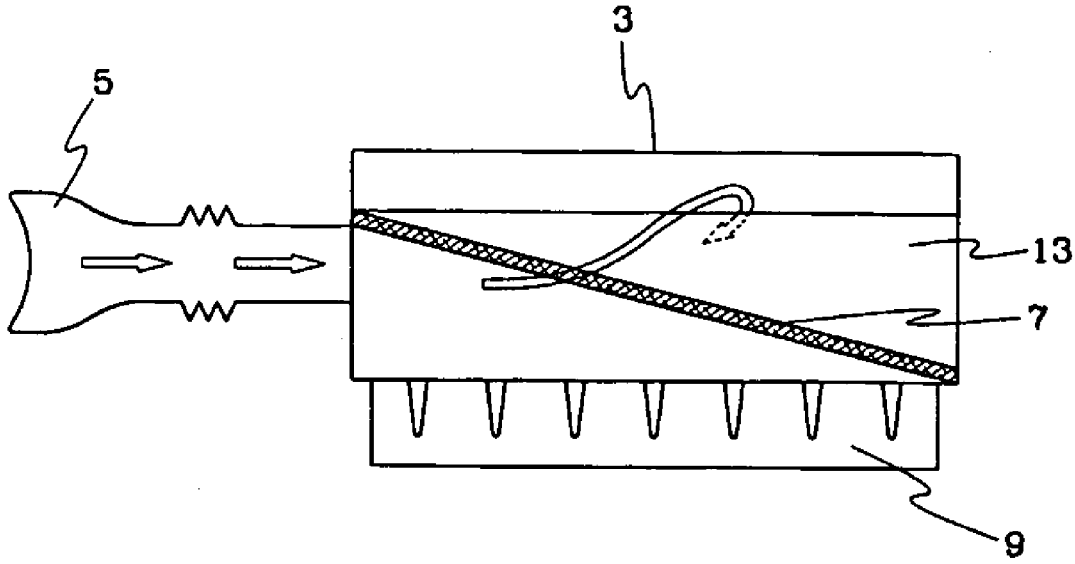
FIG. 3 is a cross-sectional view taken along line III—III of FIG. 1.
Figure 4:
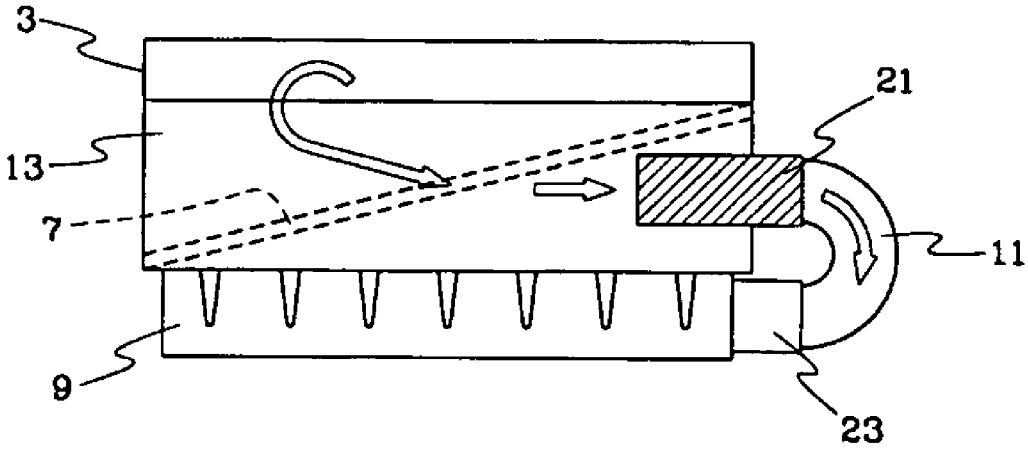
FIG. 4 is a cross-sectional view taken along line IV—IV of FIG. 1.

Referring first to FIGS. 1 to 4, an intake-air system of a V-type engine according to an embodiment of the present invention includes an intake box 3 disposed on top of cylinder heads 1, generally separated into side spaces. A passage forming means allows both spaces of intake box 3, installed along the lateral direction of the vehicle, to form an air passage therebetween. Thus, in one embodiment of the invention, the passage forming means is a duct-like structure connecting opposite spaces of box 3. An air duct 5 is connected to the front surface of one of both spaces of intake box 3. A filter element 7 is equipped at the one space of intake box 3 to filter the air entering into air duct 5. A front connecting tube 11 connects an intake manifold 9 and the front surface of the other space of intake box 3. Intake box 3 covers both cylinder heads 1 mounted on two banks set along the lateral direction of the vehicle.

The passage forming means includes a curved portion 13 configured to be depressed toward the interior of intake box 3 at the middle of intake box 3 for partially insulating both spaces of intake box 3 and for allowing the air that passes through filter element 7 at one space of intake box 3 to shift to the other space of intake box 3. Thus, the air penetrated filter element 7 flows from one space to the other space of intake box 3 through a narrow space formed between curved portion 13 and a top wall and box 3. The space formed underneath the middle portion of intake box 3 by curved portion 13 of the passage forming means can be used for other purposes.

Figure 5:
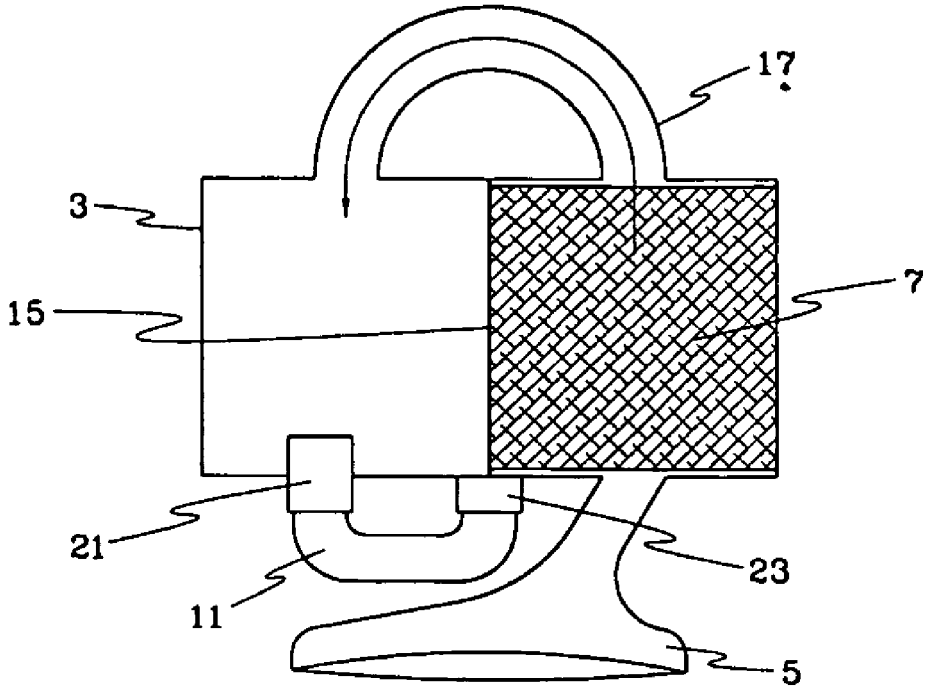
FIGS. 5 and 6 illustrate other embodiments of a passage forming means.

A passage forming means disclosed in FIG. 5 according to another embodiment of the present invention includes an isolating partition 15, which isolates the left and right side spaces of box 3 from one another, and a rear connecting tube 17. Isolating partition 15 is installed in intake box 3 to separate both spaces of intake box 3, and rear connecting tube 17 connects the rear surfaces of both spaces of intake box 3.

Figure 6:
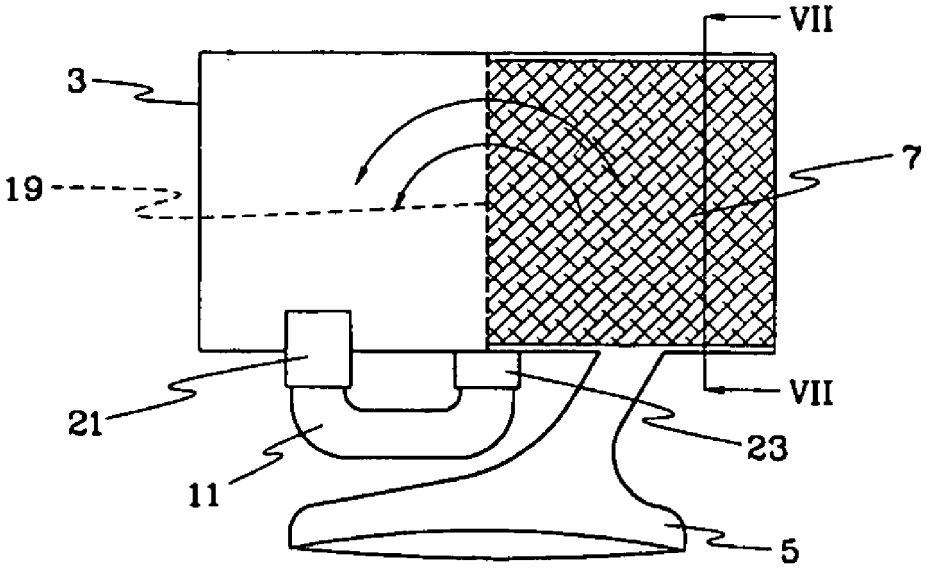

A passage forming means disclosed in FIG. 6 according to another embodiment of the present invention includes a partially isolating partition 19 that partially insulates both spaces of intake box 3 for allowing the air passed filter element 7 of one space of intake box 3 to move to the other space of intake box 3.

Figure 7:
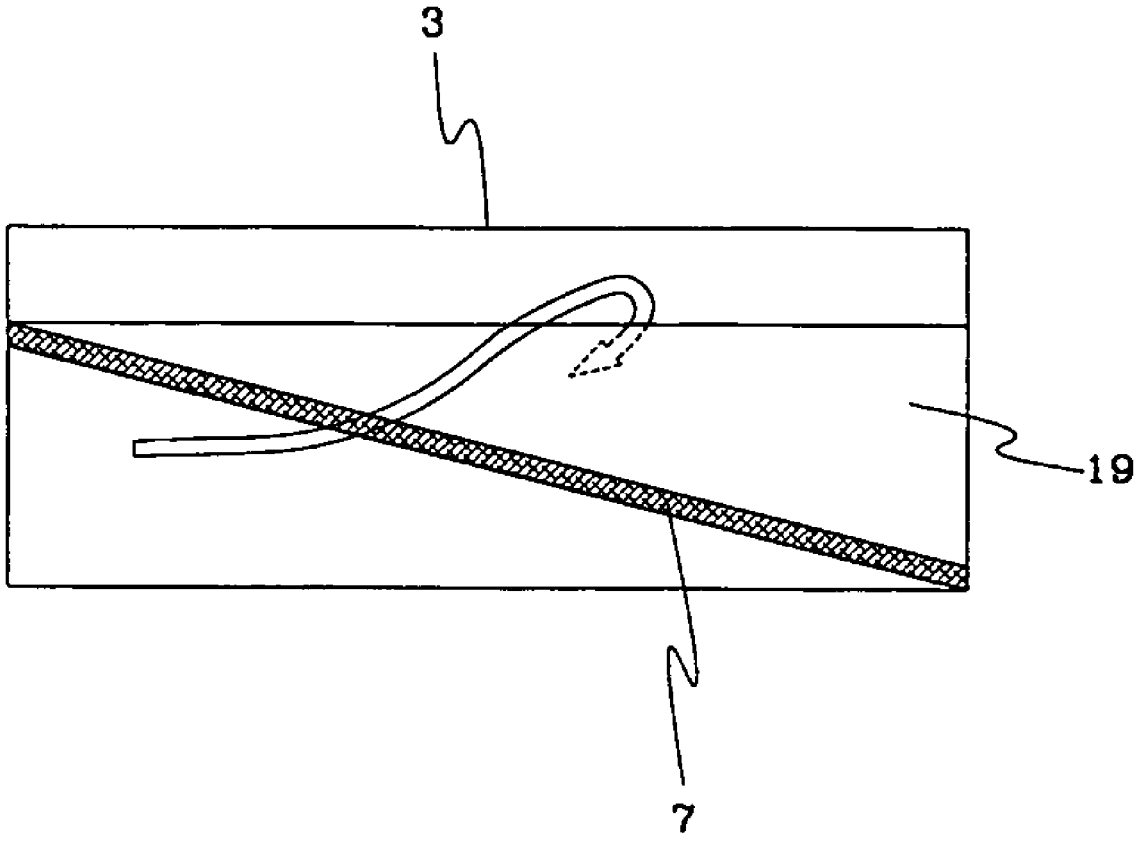
FIG. 7 is a cross-sectional view taken along line VII—VII of FIG. 6.

As illustrated in FIG. 7, partially isolating partition 19 is configured to close one surface of filter element 7. The top portion of partially isolating partition 19 is distantly located from the upper surface of intake box 3. Thus, the air having passed through filter element 7 can be shifted to the other space of intake box 3 through a space formed between the top portion of partially isolating partition 19 and the upper surface of intake box 3.

An air flow meter 21 is equipped at the joint of intake box 3 and front connecting tube 11 while a throttle body 23 is equipped at the joint of front connecting tube 11 and intake manifold 9. Front connecting tube 11 runs from the front surface of the other space of intake box 3 to intake manifold 9 placed underneath the middle of intake box 3.

The operation of the intake-air system of a V-type engine thus constructed will now be described.

The air entering into air duct 5 is filtered at one space of intake box 3 via filter element 7. The air passed through filter element 7 is supplied from one space to the other space of intake box 3 through the passage forming means.

With reference to FIG. 1, the air having passed through filter element 7 is shifted to the other space of intake box 3 by passing through the above of curved portion 13. The air taken into the other space flows to intake manifold 9 through air flow meter 21, front connecting tube 11 and throttle body 23. Throttle body 23 adjusts the amount of air taken from front connecting tube 11 to intake manifold 9.

Intake box 3 disposed along the lateral direction of the vehicle includes one space, which is connected to air duct 5 and contains filter element 7, and another space connected to front connecting tube 11. The one space containing filter element 7 functions as a conventional air cleaner box.

In most V-type engines, both banks are separated by 90 degrees, thus a sufficient space is available at the upper portion of the engine. Since intake box 3 is located on top of cylinder heads 1 of the V-type engine having the above sufficient space, a voluminous air cleaner box to reduce the intake noise can be obtained only by using the one space of intake box 3.

As the one space of intake box 3 can be large, the volume of filter element 7 installed in the above space can also be large. The enlarged one space of intake box 3 and filter element 7 effectively minimize noise of the engine intake-intake system. The cross-sectional areas of air duct 5 and intake passage can, therefore, be expanded, thereby decreasing the intake resistance and improving the engine output.

In the above intake-air system, a rapid variation of the intake-air flow is prevented by the intake passage configured to pass through the large space of intake box 3, thereby reducing the resistance of the air flow and improving the engine output.

Air flow meter 21 can randomly be placed at front connecting tube 11 or in intake box 3, preferably, at the joint of front connecting tube 11 and intake box 3. When selecting the installment place of air flow meter 21, the inlet portion of air flow meter 21 should be optimally positioned at a certain distance in order for the intake air to linearly flow thereto for improving the measuring accuracy of air flow meter 21. Hence, air flow meter 21 is preferably installed at the joint of front connecting tube 11 and intake box 3 for improving the accuracy of the engine control, reducing the exhaust gas, and the like.

As apparent from the foregoing, there is an advantage in that an intake box having an appropriate size to reduce intake noise is mounted at the upper portion of the engine by applying the structural feature of the V-type engine, thereby minimizing the intake noise. Further, the intake resistance is decreased by expanding the cross-sectional area of a relative intake passage, resulting in an improvement of the engine output.

What is claimed is:

1. An intake-air system of a V-type engine, comprising:
an intake box defining at least first and second air spaces configured to be disposed on top of cylinder heads and installed along a lateral direction of a vehicle;
passage forming means that allows communication between the spaces of said intake box;
an air duct connected to a front surface of one of both spaces of said intake box;
a filter element equipped in said one space of said intake box for filtering air entering into said air duct; and
a front connecting tube connecting an intake manifold and a front surface of the other space of said intake box;
wherein said passage forming means includes:
an isolating partition installed in said intake box to separate both spaces of said intake box; and
a rear connecting tube allowing rear surfaces of both spaces of said intake box to communicate with each other.

2. An intake-air system of a V-type engine, comprising:
an intake box defining at least first and second air spaces configured to be disposed on top of cylinder heads and installed along a lateral direction of a vehicle;
passage forming means that allows communication between the spaces of said intake box;
an air duct connected to a front surface of one of both spaces of said intake box;
a filter element equipped in said one space of said intake box for filtering air entering into said air duct; and
a front connecting tube connecting an intake manifold and a front surface of the other space of said intake box;
wherein said passage forming means includes a partially isolating partition that partly insulates the spaces of said intake box from each other and allows air having passed through said filter element at one space of said intake box to move to the other space of said intake box.

3. An intake-air system of a V-type engine, comprising:
an intake box defining at least first and second air spaces configured to be disposed on top of cylinder heads and installed along a lateral direction of a vehicle;
passage forming means that allows communication between the spaces of said intake box;
an air duct connected to a front surface of one of both spaces of said intake box;
a filter element equipped in said one space of said intake box for filtering air entering into said air duct; and
a front connecting tube connecting an intake manifold and a front surface of the other space of said intake box;
wherein said passage forming means includes a portion curved toward an interior of said intake box at a middle of said intake box for partially isolating both spaces of said intake box and for allowing the air having passed through said filter element at one space of said intake box to move to the other space of said intake box.

4. An intake-air system of a V-type engine, comprising:
an intake box defining at least first and second air spaces configured to be disposed on top of cylinder heads and installed alone a lateral direction of a vehicle;
passage forming means that allows communication between the spaces of said intake box;
an air duct connected to a front surface of one of both spaces of said intake box;
a filter element equipped in said one space of said intake box for filtering air entering into said air duct; and
a front connecting tube connecting an intake manifold and a front surface of the other space of said intake box;
wherein said front connecting tube runs from a front surface of the other space of said intake box to said intake manifold placed underneath the middle of said intake box.

5. An intake-air system, comprising:
a first laterally defined air space;
a second laterally defined air space adjacent to the first lateral air space;

air communication means extending between said spaces;

an air duct connected to said first air space;

a filter element disposed in said first air space; and a connecting to configured and dimension to connect the second air space to an intake manifold;

wherein said first and second air spaces are formed as a single box.

6. The intake-air system of claim 5, wherein said communication means a duct-like structure extending between said air spaces adjacent a top cover of the box.

7. The intake-air system of claim 5, where said communication means comprises an external curved connecting tube between said air spaces.

8. The intake-air system of claim 5, wherein said connection means comprises a partially isolating wall between said spaces forming an air passage therebetween.

9. The system as defined in claim 1, wherein said intake box is configured and dimensional to cover both cylinder heads mounted on two banks set along a lateral direction of the vehicle.

10. The system as defined in claim 2, wherein said intake box is configured and dimensional to cover both cylinder heads mounted on two banks set along a lateral direction of the vehicle.

11. The system as defined in claim 3, wherein said intake box is configured and dimensional to cover both cylinder heads mounted on two banks set along a lateral direction of the vehicle.

12. The system as defined in claim 1, wherein an air flow meter is equipped at a joint of said intake box and front connecting tube.

13. The system as defined in claim 2, wherein an air flow meter is equipped at a joint of said intake box and front connecting tube.

14. The system as defined in claim 3, wherein an air flow meter is equipped at a joint of said intake box and front connecting tube.

15. The system as defined in claim 1, wherein a throttle body is installed at a joint of said front connecting tube and intake manifold.

16. The system as defined in claim 2, wherein a throttle body is installed at a joint of said front connecting tube and intake manifold.

17. The system as defined in claim 3, wherein a throttle body is installed at a joint of said front connecting tube and intake manifold.

* * * * *